United States Patent [19]

Bourgois et al.

[11] Patent Number: 4,785,617

[45] Date of Patent: Nov. 22, 1988

[54] PRODUCTION OF STEEL CORD

[75] Inventors: Luc Bourgois, Desselgem; Luc Sabbe, Deerlijk, both of Belgium

[73] Assignee: N.V. Bekaert S.A., Zwevegem, Belgium

[21] Appl. No.: 39,987

[22] Filed: Apr. 20, 1987

[30] Foreign Application Priority Data

May 27, 1986 [GB] United Kingdom ..... 8612835

[51] Int. Cl.[4] ..... D07B 3/00; D07B 3/12

[52] U.S. Cl. ..... 57/58.52

[58] Field of Search ..... 57/58.52, 58.54, 58.55, 57/58.63

[56] References Cited

U.S. PATENT DOCUMENTS 3,271,941 9/1966 Haugwitz .
3,309,857 3/1967 Haugwitz ..... 57/58.52
3,564,831 2/1971 Bonnabaud ..... 57/58.52
4,368,614 1/1983 Groza et al. ..... 57/58.52

FOREIGN PATENT DOCUMENTS 2052585 1/1981 United Kingdom .

*Primary Examiner*—Donald Watkins
*Attorney, Agent, or Firm*—Foley & Lardner, Schwartz, Jeffery, Schwaab, Mack, Blumenthal & Evans

[57] ABSTRACT

A process and machine for making a cord in a structure of one or more layers of filaments, all twisted with a same twist pitch p around a core in which the filaments are not twisted around each other with that same twist pitch p. The cord is made in one continous process in which the core filaments are bundled in a twister, then the layer filaments are joined in parallel to the core bundle on exit from the twister, and the whole is then twisted in a double-twist bunching machine.

6 Claims, 5 Drawing Sheets

PRODUCTION OF STEEL CORD

The invention relates to a method and apparatus for producing a steel cord and in particular a cord construction suitable for the reinforcement of elastomeric articles, such as for example rubber tires.

Previously there has been known a regular single-bundle cord, in which a core and one or more surrounding layers can be distinguished, the whole being twisted with a same twist pitch p in one single operation. This cord has the advantage of compactness and low fretting wear, and the possibility of being made in one single continuous operation on a double-twist bunching machine. However this cord suffers from the problem of core migration when used in tyres. One or more core filaments begin to shift lengthwise, emerging at one end of the cord and puncturing through the rubber. For that reason it is preferred to depart from perfect regularity of the filaments, with one or more filaments of the core having another pitch q than the general pitch p of the other filaments of the cord. But such an irregular cord can however no longer be made in one continuous operation on a double-twist bunching machine, as was the case for the regular single bundle cord.

Viewed from one broad aspect there is herein disclosed a method of producing steel cord comprising a core and at least one layer of filaments twisted with the same pitch p around the core, the core having a structure comprising a first number m of filaments, and a second number n of filaments in an m+n−configuration with a twist pitch q different from the twist pitch p comprising the steps of twisting filaments together into a core bundle by means of a twister in which each unwinding coil for a filament of said first number m is location inside the rotor of said twister, bundling said core bundle that leaves the twister together with a number of filaments travelling at the same speed as said core bundle and forming a layer around it, and leading the resulting filament bundle into a double-twist bunching machine, having a winding-up spool located inside the flyer.

By an m+n−configuration with a twist pitch q it is meant that all the filaments of the first number m are twisted with a twist pitch q around all the filaments of the second number n. The number of filaments in each group m or n is at least one. The filaments of one group if their number is more than one, are not necessarily twisted with respect to each other with that same twist pitch q. Most often the filaments of the group m can for instance be parallel (this means an infinite twist pitch), whereas the filaments of the group n ca be twisted with respect to each other with the same twist pitch p as the filaments of the layer, so that these do not depart from the regularity of pitch of the majority of filaments and form a line contact with the adjacent filaments of the layer.

The unwinding coil or coils for the filaments of the second number n, can be located inside or outside said rotor, depending on the desired core structure, but they will preferably be located outside the rotor.

Viewed from another broad aspect there is herein disclosed apparatus for producing steel cord comprising in sequence a twister with at least two unwinding spools and adapted for continuously delivering a filament bundle at its exit, a bundling device associated with an unwinding unit and adapted for unwinding and bundling a number of filaments together with the filament bundle leaving said twister, and a double-twist bunching machine comprising a winding-up spool inside its flyer, adapted to receive at its entrance the resulting bundle leaving said bundling device.

It is possible to pass said core bundle with said layer, on its way from the bundling device to the entrance of said double-twist bunching machine, through an additional bundling device, and to guide an additional number of filaments from an additional unwinding unit to join said core bundle with its layer to form an additional layer. The resulting cord will then have two layers of filaments, twisted with the same pitch p around the core. A similar use of a further additional bundling device and a further additionoal layer of filaments will provide a cord with three layers around the core, and so on. One or at most two layers are however preferred.

By "layer" is meant a group of filaments which, in cross-section, show a concentric disposition of the filament cross-sections. But it is not necessary tht the filaments for a layer be sufficient in number to form a closed layer around its core. The failing of one or two filaments may be desirable to improve the rubber penetration in the core and hence, the resistance to corrosion.

The twister for the core filament is preferably a double-twist bunching machine, in which each unwinding coil for a filament of the first number m is located inside the flyer and in which preferably each unwinding coil for a filament of said second number n is located outside the flyer, as will be shown hereinafter.

The twister can however also be a twister according to another principle, e.g. a single-twist stranding machine or a tubular stranding machine, as will also be shown hereinafter.

Some embodiments of the above broad aspects will now be described, by way of example, with reference to the accompanying drawings in which.

Figure 1:
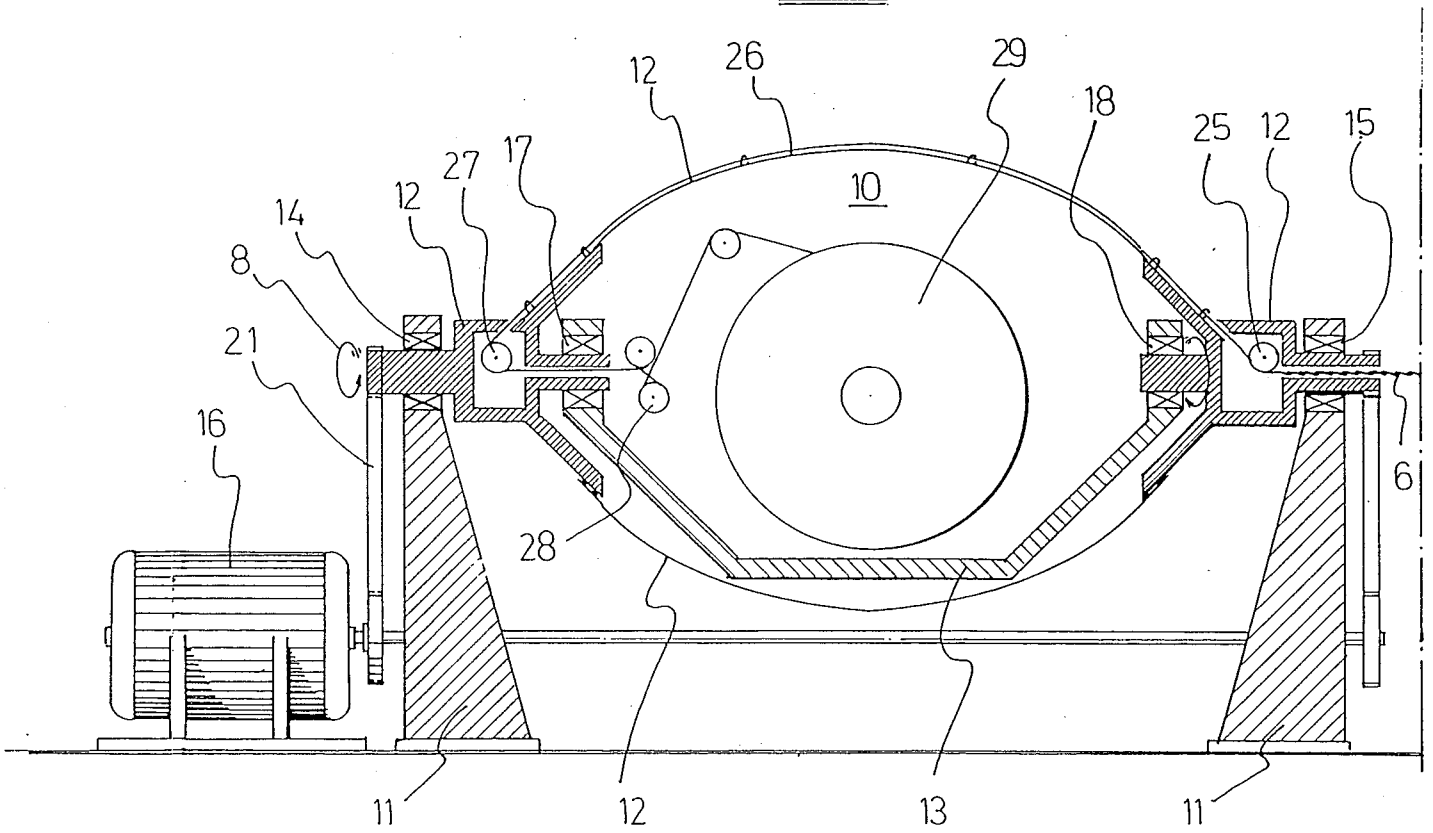
FIG. 1 shows the winding-up part of apparatus according to one embodiment.
Figure 2:
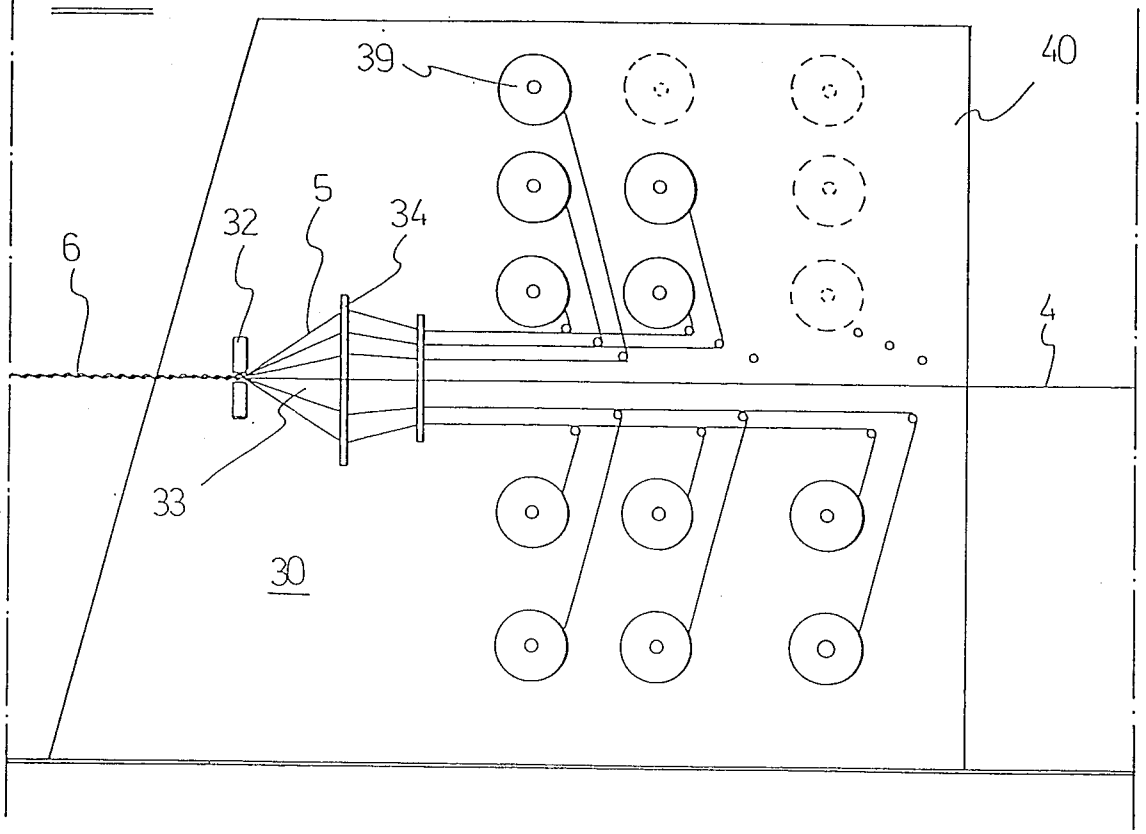
FIG. 2 shows the bundling device of apparatus according to one embodiment.
Figure 3:
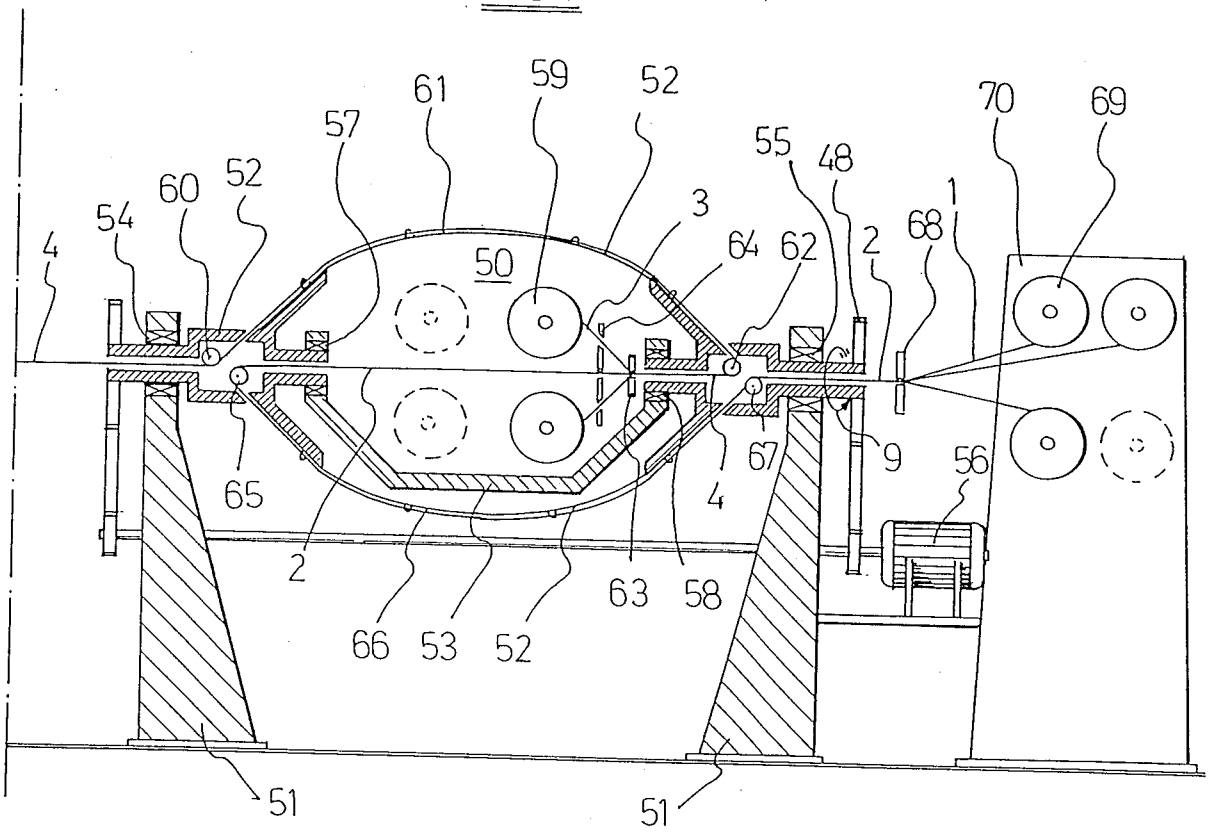
FIG. 3 shows a twister in the form of a double-twist bunching machine.

The apparatus comprises three main units, shown in FIGS. 1, 2 and 3 respectively, these three figures being intended to be in sequence together from left to right. During manufacturing, the filaments travel generally from right to left in the drawings.

FIG. 1 shows the winding-up unit, which is in the form of a double-twist bunching machine 10. The double-twist bunching machine comprises a fixed frame 11, a rotor 12, mounted in said fixed frame for rotation, a cradle 13, freely rotatable inside the rotor around the same axis of rotation as the rotor so as to remain stationary when the rotor rotates, the cradle 13 comprising a creel for one or more spools 29 so designed that the rotor can freely rotate around the cradle, the rotor comprising at least one flyer 26, adapted to guide the filament from the axis on one side of the machine over the cradle back towards the axis on the other side of the machine. In this embodiment, the machine 10 is provided with only one spool 29, arranged to be operable as a winding-up spool, and with a drawing capstan 28, so that the machine is arranged as a winding-up unit. The rotor 12 is mounted in this case between two coaxial bearings 14 and 15 and driven by electric motor 16 through gearing 21. The cradle 13 is mounted between two bearings 17 and 18 which are coaxial with bearings 14 and 15.

FIG. 3 shows a twister for the core filaments. In this example, it is in the form of a double-twist bunching machine 50, with its fixed frame 51, a rotor 52, a cradle 53 comprising a creel inside the rotor for a number of spools 59, in this example four, arranged in order to be operable as unwinding spools. In this example, the twister also comprises a fixed creel 70 for a number of unwinding spools 69, located outside the rotor 52 of the double-twist bunching machine 50. In this example, the rotor 52 comprises two flyers 61 and 66, diametrically opposite to each other with respect to the axis of rotation, for guiding the filament from the axis on one side of the machine over the cradle back towards the axis on the other side of the machine. The rotor 52 is driven by means of an electric motor 56 through the gearing 48.

In this embodiment, the twister comprises means for mounting four spools 59 inside the rotor 52, and means for mounting four spools 69 outside the rotor 52, so that all combinations can be made of one to four filaments of the first number m of core filaments with one to four filaments of the second number n of core filaments. In the drawing, only two spools 59 are shown mounted inside the rotor, and three spools 69 outside, so that in this example, it is intended to provide a cord with a core of two filaments twisted with a pitch q around three other filaments. The difference between this twist pitch q and the twist pitch p of the filaments of the surrounding layer will be determined by the rotation speed of the machine 50.

FIG. 2 shows a bundling device 30 where a layer of eleven filaments 5 is laid around the core bundle 4, after the latter has left the twister 50. To this end, the core bundle 4 is led through a twisting-head 32, where the filaments 5 for the surrounding layer are guided along a distributor plate 34 for forming fixed converging paths 33 to join the core bundle 4 and to travel further with said core bundle at the same speed. The filaments 5 are drawn off from a number of individual unwinding spools 39, located on a fixed creel 40. After leaving the twisting-head 32, the filament bundle 6, comprising the core bundle surrounded by its layer of filaments, is further led towards the winding-up unit of FIG. 1.

In FIG. 3, the filaments are unwound from their respective individual spools 69 and are made to converge towards an opening in a guiding plate 68 where they are bundled. From there, the bundle 2 enters the rotor 52 through bearing 55 and axially from right to left and is further guided over a pulley 67 inside the rotor axis towards the flyer 66 which leads the bundle over the cradle 53 towards the axis of the rotor at the left side, and there the bundle is guided over a pulley 65 where its direction of travel is reversed from left to right. The bundle 2 then travels axially, through bearing 57 of the cradle 53 and enters the cradle, where it passes straight on through a distributor plate 64 and a twisting-head 63. At the same time, the filaments 3 are unwound from spools 59 in the cradle, and are led via a number of openings in distributor plate 64 towards the twisting-head 63, where they come to join the bundle 2, and form together the core bundle 4. This core bundle travels further from left to right, and leaves the cradle axially through bearing 58 back into the right side of the rotor 52. Inside the axis of the rotor at the right side, the core bundle is guided over a pulley 62 where its direction of travel is reversed from right to left again, and passes through the flyer 61, over the cradle 53 towards the axis of the rotor at the left side. And there, the core bundle is led, over a pulley 60 inside the axis of the rotor, in an axial direction from right to left through bearing 54, to leave the machine 50.

The core bundle then enters the bundling device 30 on FIG. 2, in which eleven filaments 5 come to join the core bundle, forming in the twisting-head 32 a layer around the core. To this end, the filaments 5 pass through individual openings in a distributor plate 34, in which the openings are equally distributed in a circle around a central opening for the core bundle 4. The final bundle 6 with all the filaments for the cord, after leaving the twisting-head 32, then travels further towards the winding-up unit 10.

In the winding-up unit (FIG. 1), the cord bundle 6 enters the rotor of the double-twist bunching machine 10, axially from right to left through bearing 15 of the rotor 12. Within the rotor, the bundle 6 passes over a pulley 25 and is led, via flyer 26 of the rotor, over the cradle 13 towards the left side of the rotor, where its direction of travel is reversed, by means of pulley 27 inside the axis of the rotor, so that the bundle 6 travels axially from left to right through bearing 17, and enters cradle 13. There the bundle is drawn by a capstan 28 and wound up on winding-up spool 29. The capstan 28 is driven in synchronism with rotor 12, and draws the filaments through the machine, so as to determine the travelling speed V. The proportion of this travelling speed to the speed of rotation $r_1$ of the rotor determines the pitch p.

The way in which the different filaments for the cords are twisted can be more easily explained firstly by assuming that the guiding pulleys and other guiding members do not allow the filaments and the core to rotate around their longitudinal axis. Under this assumption, the places where certain amounts of twist are given are well localized. The rotors of both double-twist bunching machines 10 and 50 are assumed to rotate in the same sense, as indicated by the arrows 8, respectively 9, but with different rotation speeds $r_1$ and $r_2$ respectively. The bundle 2 of three filaments 1 receives between guiding plate 68 and twisting-head 63 a twist pitch $$\frac{V}{2r_2}$$

in the S-direction. In the twisting-head 63, two additional filaments 3 come to join the bundle 2 to form the core bundle 4. And between twisting-head 63 and twisting-head 32, the core bundle 4 receives a twist pitch $$\frac{V}{2r_2}$$

in the Z-direction. The result is, that in the core, the original bundle 2 of filaments coming from the spools 69 untwists again and that the core bundle 4, when entering the twistinghead 32 has three untwisted filaments around which two filaments, those coming from spools 59, are twisted with a twist pitch of $$\frac{V}{2r_2}$$

in the Z-direction. In twisting-head 32, the filaments 5 for the layer around the core, come to join the core bundle 4, and the resulting bundle 6 receives, between twisting-head 32 and drawing capstan 28, a twist with a twist pitch of $$\frac{V}{2r_1}$$

in the S-direction. As a result, all the filaments which were untwisted when entering the twisting-head 32, i.e. those coming from creels 40 and 70, have a twist pitch $$p = \frac{V}{2r_1}$$

around each other in the S-direction, and the two filaments coming from inside the rotor of twister 50 are twisted around the three filaments coming from creel 70, with a twist pitch in the S-direction of $$q = \frac{V}{2}\left(\frac{1}{r_1 - r_2}\right) \text{or } q = p\left(\frac{1}{r_1 - r_2}\right).$$

In this way, the difference of pitch between p and q can be accurately controlled by the speed of rotation of twister 50.

In reality however, the guiding members and pulleys are not made so as to prevent rotation of the guided filament or bundle around its longitudinal axis. The result is that the twists are not given at the exact locations as explained above. This results into the fact that, for instance, the locations where opposite twists are given, can travel towards each other and meet each other so that the opposite twists cancel each other and are never given, or only partly, to the extent that rotation of the filaments and bundles is allowed. It is even possible, not only not to prevent rotation, but to promote rotation by the use of rotating pulleys which drive the bundle into rotation around its axis. It is possible in this way, for instance, to drive the bundle 6, between its exit from twisting-head 32 and its entrance into the double-twist bunching machine 10, with a rotation speed of $2r_1$ around its axis in the same sense as the rotor of machine 10, in order to ensure that the location where the twist pitch p is given be shifted completely up-stream towards the twisting-head 32. It is also possible to drive only the core bundle 4, on exit from the twister 50, with the rotation speed of $2r_1$, in order to ensure that the location for the twists in the core bundle be completely shifted upstream towards the twister 50, so as to meet the location for opposite twists of twister 50.

Figure 5:
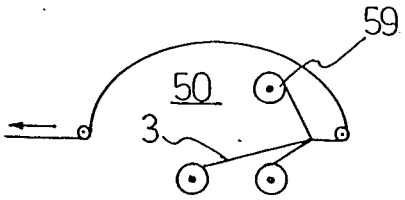
FIG. 5 shows schematically a second way of loading the twister when the core to be obtained comprises three filaments.
Figure 4:
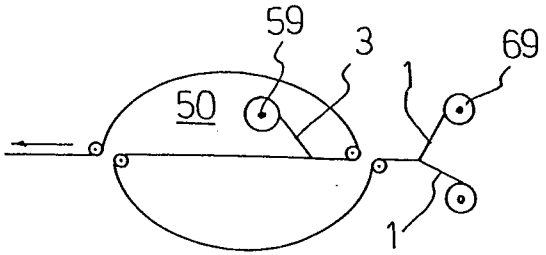
FIG. 4 shows schematically a first way of loading the twister with unwinding bobbins, when the core to be obtained comprises three filaments.
Figure 6:
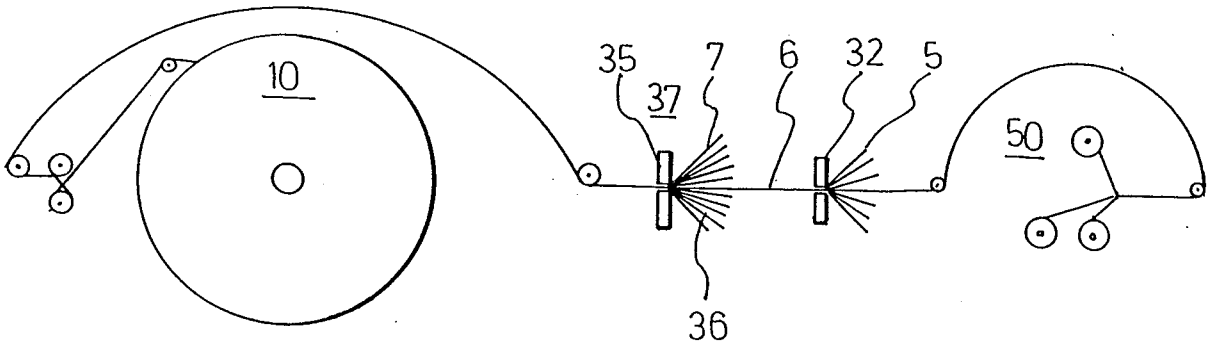
FIG. 6 shows schematically apparatus for laying two layers of filaments.

The twister according to FIG. 3 can be used in other ways for making cords of the same type, as schematically shown in FIGS. 4 to 6.

In the cases when the core has three filaments for example, the spools for the core can be mounted in the twister 50 of FIG. 3 as shown in FIG. 4. The first group comprising m=1 filament 3 and its unwinding spool is mounted inside the rotor, whereas the second group comprises n=2 filaments 1 and its unwinding spools is mounted outside the rotor. The result will be a cord with a core in which the filaments 1 have a twist pitch p around each other, and that the filament 3 will be twisted around the filaments 1 with a twist pitch q. The spools for the second group of n=2 filaments can also be mounted inside the rotor (FIG. 5). The result will be a cord in which the three filaments 3 are twisted around each other with a twist pitch q. Also in this case, a first number of m=1 filament and a second number of n=2 filaments can still be distinguished in the core, in which the filaments of the first number are twisted around the filaments of the second number with the twist pitch q. The same applies, mutatis mutandis, when the core has only two filaments. One of the spools is then always mounted inside the rotor, and the other can be mounted either inside, or outside the rotor. The result will still be a cord with a core of m=1 and n=1 filaments, the m filaments being twisted around the n filaments with a twist pitch q.

FIG. 6 shows how to make a cord with two layers around the core. The machine comprises, between the bundling device 30 of FIG. 2 and the entrance of the double-twist bunching machine 10 of FIG. 1, an additional bundling device 37, comprising an additional twisting-head 35 associated with an additional fixed unwinding unit (not shown but similar to creel 40 and distributor plate 34 of FIG. 2) adapted for unwinding and guiding an additional number of filaments along fixed converging paths 36 towards the additional twisting-head 35 for forming the second layer. In this way it is possible to make e.g. a 3+9+15—structure, in which the two layers of nine and fifteen filaments have the same twist pitch p, and in which the three filaments of the core depart from the regular twisting structure in which they would also be twisted together with the twist pitch p. Instead, in the cord may by this embodiment, the three core wires can be divided in two groups 1+2 in which the first group is twisted around all the filaments of the second group with a twist pitch q, different from the twist pitch p of the layer.

Figure 7:
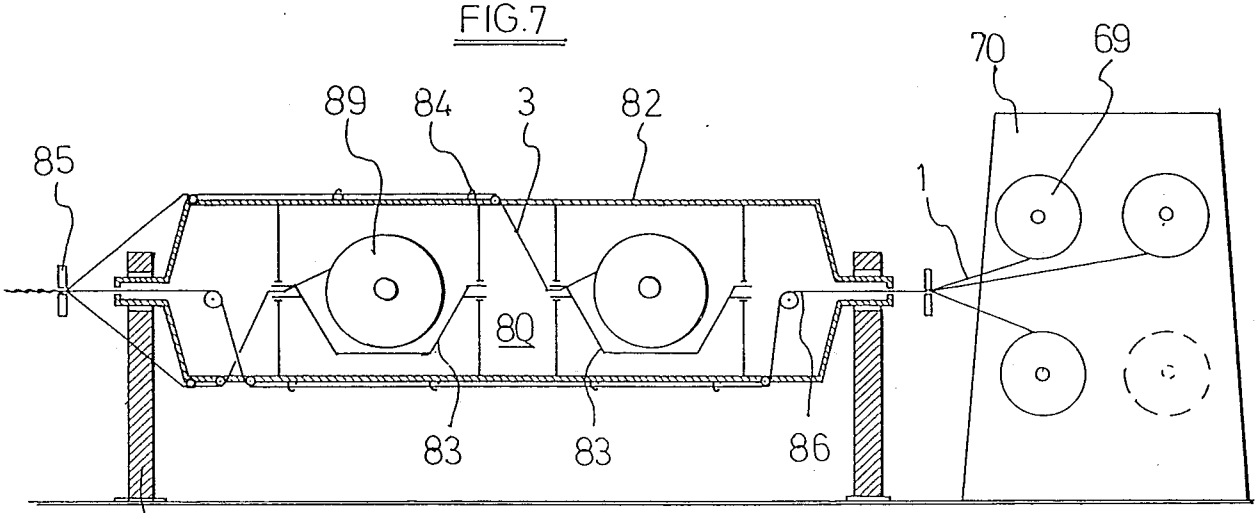
FIG. 7 shows a single-twist stranding machine, which can be used for the twister instead of a double-twist bunching machine of FIG. 1.

The twister for the core filaments does not have to be a double-twist bunching machine as shown in FIG. 3. It can also be, for example, a single-twist stranding machine 80, as shown in FIG. 7. This is a machine which comprises a fixed frame 81, a rotor 82, mounted in said fixed frame to be driven into rotation, a number of cradles 83 (at least one) comprising an unwinding spool 89 and, freely rotatable inside the rotor around the same axis of rotation as the rotor so as to remain stationary when the rotor rotates, the cradles, if more than one, being aligned along said axis of rotation from an upstream side (this is the right side in FIG. 7) to a downstream side, a number of filament guiding paths 84, each one being adapted to guide the filament of one of said unwinding spools 89 over any downstream cradle towards the circumference of the rotor at the downstream side, and further towards a common twisting-head 85 for all the filaments. The rotor most often has a tubular form.

It is known that in such single-twist stranding machine, the filaments 3 coming from the spools 89 on the cradles 83 receive one twist around each other per revolution of the rotor 82, and that the individual filaments do not receive any twist around their own axis. In contrast herewith a double-twist bunching machine 50 as in FIG. 3 gives the filaments 3 coming from the spools 59 on the cradle 53 two twists around each other per revolution of the rotor 52, and the individual filaments receive two twists around their own axis.

In the example of FIG. 7, the machine also comprises a same fixed creel 70 for a number of unwinding spools 69 as in FIG. 3, located outside the rotor 82 of the single-twist stranding machine 80. In this example, the rotor 82 further comprises an additional guiding path 86, adapted for guiding the filaments 1 from the axis at the upstream side of the machine, over the cradles 83, towards the axis at the downstream side of the machine.

In the example of FIG. 7, the twister comprises means for mounting two spools 89 inside the rotor 82, and means for mounting four spools 69 outside the rotor, so that all combinations can be made of one to two filaments of the first number m of core filaments with one to four filaments of the second number n. In FIG. 7, there are two spools 89 inside, and three spools 69 outside the rotor, so that the result of the whole process will be a cord in which all the filaments coming from creels 40 (FIG. 2) and 70 (FIG. 7) have a same twist pitch p around each other, and in which the filaments coming from inside the rotor of twister 80 are twisted around the three filaments coming from creel 70 with a twist pitch q which is different from the twist pitch n of the surrounding layer.

In cases when the core has only two filaments, one of the unwinding spools is always mounted inside the rotor 82, and the other unwinding spool can be mounted either inside or outside the rotor.

The unwinding spools, especially those outside the rotors (39, 69), can each comprise an individual double-twist flyer arm. Each individual wire is then unwound from its spool over such individual flyer arm, which rotates at the necessary speed to impart the filament, on unwinding, an individual twist around its own axis of the same value but of the opposite sense as the individual twist which the filament will receive during the remainder of the process towards the winding-up spool.

Figure 8:
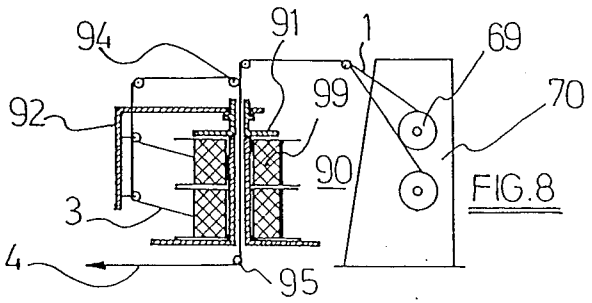
FIG. 8 shows another type of twister.

The notion of a twister with a rotor having m spools inside the rotor does not mean that the unwinding spools have to be mounted in a cradle inside the rotor. There are cases in which the unwinding spools can be fixed, as shown in FIG. 8. The unwinding spools 99 are still inside the rotor, because the rotor 92 rotates around the spools.

The twister 90 according to FIG. 8 comprises a fixed frame 91 in the form of an axle on which two (m=2) spools 99 are mounted. A rotor in the form of an arm 92 rotates around the axle for drawing off the filaments 3 from the spools and guiding them towards the axis at the upper side of the axle, over pulley 94, through the core of the axle and of the spools 99, towards pulley 95 at the lower side of the axlw. At pulley 94 however two (n=2) filaments 1, coming from two spools 69 outside the rotor 92, join the filaments 3, and also pass the core of the axle and of the spools 99 towards pulley 95, where the resulting core bundle 4 leaves the twister 90. The twist pitch q will here be determined by a number of factors : the rotational speed of the arm 92, the linear speed at which the core bundle 4 is drawn out of the twister and the filling degree of the coils 99. The coils 99 can also be mounted, instead of being fixed, in a way so as to rotate around their own axis.

It is clear that the invention is not limited to the examples given hereinabove, and that all parts of the machine or process can be replaced by an equivalent without departing from the scope of the invention. The invention is specifically not limited to a twist pitch q which would not be infinite, i.e. both groups of wires of the core can run besides each other, and the twist pitch q is then infinite, which is a twist pitch different from the twist pitch p of the surrounding layer. Similarly, a twist pitch q, which has the same absolute value as the twist pitch p of the surrounding layers, but which has an opposite sense, is to consider as a twist pitch-p, and consequently, different from twist pitch p.

Nor is the invention limited to any specific form of what is called here a "twisting-head". This is in general any device capable of bundling the filaments together and let them pass: this can be an orifice in a die or a plate, as well as, e.g. the groove of a guiding pulley. The filaments do not necessarily all join the core bundle at the same point, in so far as they are finally bundled together with the core and form a layer around it that travels at the same speed as the core bundle towards the entrance of the double-twist bunching machine 10.

Thus it will be seen that, at least in preferred forms, there is disclosed a method and apparatus by which a specific family of irregular cords can be made in one continuous process from the individual unwinding coils towards the windingup coil of the finished cord. By means of this method in its preferred forms, all the filaments which keep the general pitch p and do not depart from the regularity of twist pitch (and this is the vast majority of the filaments) can have their unwinding coils outside the rotating parts of the machine, so that these parts can be designed as small as possible.

The steel cord produced by the method disclosed hereinabove, at least in its preferred forms, is suitable for the reinforcement of elastomeric articles, such as for example rubber tyres. The method and apparatus will therefore be adapted for filaments for such use which have in general a diameter ranging from 0.03 to 0.80 mm, a tensile strength of at least 2000 $N/mm^2$ and an elongation at rupture of at least 1%.

The steel cord construction disclosed herein forms a family of irregular cords, which can be made in a single continuous process.

We claim:

1. A process of producing a steel cord in a first twister, said cord comprising a core and at least one layer of filaments, twisted with the same twist pitch p around the core, the core having a structure comprising a first number m of filaments, and a second number n of filaments in an m+n configuration with a twist pitch 1 different from the twist pitch p, comprising the steps of twisting filaments together into a core bundle by means of said twister having a rotor including a plurality of unwinding coils therein, in which each unwinding coil for a filament of said first number m is locate inside the rotor of said twister, bundling said core bundle that leaves the twister at a first speed together with a number of other filaments from an associated bundling device, said other filaments travelling at the first speed and forming a filament bundle therewith, and leading the filament bundle into a second twister arranged as a double-twist bunching machine and as a winding up unit having at least one flyer and a winding up spool located inside the flyer mounted therein.

2. A method according to claim 1, in which each unwinding coil for a filament of said second number n is located outside the rotor of said twister.

3. A method according to claim 1 in which said filament bundle, after receiving said other filaments and before being led into the second double-twist bunching machine comprising said winding up spool, is bundled together with a further number of filaments travelling in parallel and at said first speed and forming an additional layer around said filament bundle.

4. Apparatus for producing a steel cord comprising in sequence: a first twister with at least two unwinding spools and adapted for continuously delivering a core bundle at an exit thereof, a bundling device including an unwinding unit adjacent said twister and adapted for unwinding an bundling a number of other filaments together with the core bundle leaving said twister to form a filament bundle, and a second twister arranged or a double-twist bunching machine and as a winding-up unit comprising a flyer having a winding-up spool therein and adapted to receive at an entrance thereof the filament bundle leaving said bundling device.

5. Apparatus according to claim 4, in which said twister comprises a creel for a number of unwinding spools located outside said twister.

6. Apparatus according to claim 4 comprising between said bundling device and the entrance of the second double twist bunching machine comprising said winding-up unit, an additional bundling device associated with an additional unwinding unit and adapted for unwinding and bundling a further number of filaments together with said filament bundle.

* * * * *